US008978518B2

(12) United States Patent
Gasman

(10) Patent No.: US 8,978,518 B2
(45) Date of Patent: Mar. 17, 2015

(54) DOUBLE LEVER CORKSCREW

(75) Inventor: Charles Gasman, Paris (FR)

(73) Assignee: Mastrad, S.A., Paris (FR)

( * ) Notice: Subject to any disclaimer, the term of this patent is extended or adjusted under 35 U.S.C. 154(b) by 306 days.

(21) Appl. No.: 13/810,444

(22) PCT Filed: Mar. 24, 2011

(86) PCT No.: PCT/FR2011/000174
§ 371 (c)(1),
(2), (4) Date: Apr. 8, 2013

(87) PCT Pub. No.: WO2012/007649
PCT Pub. Date: Jan. 19, 2012

(65) Prior Publication Data

US 2013/0269486 A1 Oct. 17, 2013

(30) Foreign Application Priority Data

Jul. 16, 2010 (FR) ..... 10 02997

(51) Int. Cl.
*B25B 7/04* (2006.01)
*B67B 7/04* (2006.01)

(52) U.S. Cl.
CPC ..... *B67B 7/0423* (2013.01); *B67B 7/0429* (2013.01)
USPC ..... 81/3.37; 81/3.55

(58) Field of Classification Search
USPC ..... 81/3.35, 3.36, 3.37, 3.45, 3.55, 3.47, 81/3.56, 3.48; 7/151, 154, 155
See application file for complete search history.

(56) References Cited

U.S. PATENT DOCUMENTS 6,032,553 A * 3/2000 Brucart Puig et al. ..... 81/3.09
7,614,323 B2 11/2009 Warner

FOREIGN PATENT DOCUMENTS

| | | |
|---|---|---|
| EP | 1 316 527 | 6/2003 |
| ES | 2 332 081 A1 | 1/2010 |
| FR | 2 950 330 A1 | 3/2011 |

OTHER PUBLICATIONS

International Search Report, PCT/FR2011/000174—Mar. 8, 2011.
Written Opinion of the International Searching Authority, PCT/FR2011/000174, Int'l Filing Date Mar. 24, 2011.

* cited by examiner

*Primary Examiner* — David B Thomas
(74) *Attorney, Agent, or Firm* — Novak Druce Connolly Bove + Quigg LLP

(57) ABSTRACT

A corkscrew includes an elongate body, an auger pivotally mounted to the body, a first bearing arm pivotally mounted to the elongate body at a first distance from the auger, and a second bearing arm slidably mounted on the first bearing arm. The first and second bearing arms each have a shoulder, the shoulders being aligned adjacent one another. A connecting rod is pivotally mounted to the elongate body at a second distance which is greater than the first distance and pivotally engaged with the second bearing arm. During the extraction of a cork, the first bearing arm begins the extraction in engagement with the rim of the bottle neck. As the elongate body is tilted, the second bearing arm in turn engages with the rim of the bottle neck in order to take over from the first lever and fully extract the cork.

8 Claims, 3 Drawing Sheets

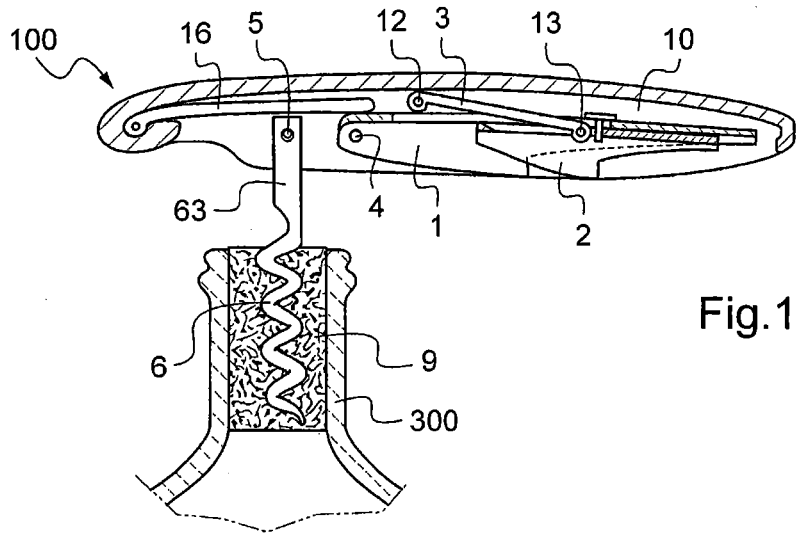
Fig.1
Fig.2
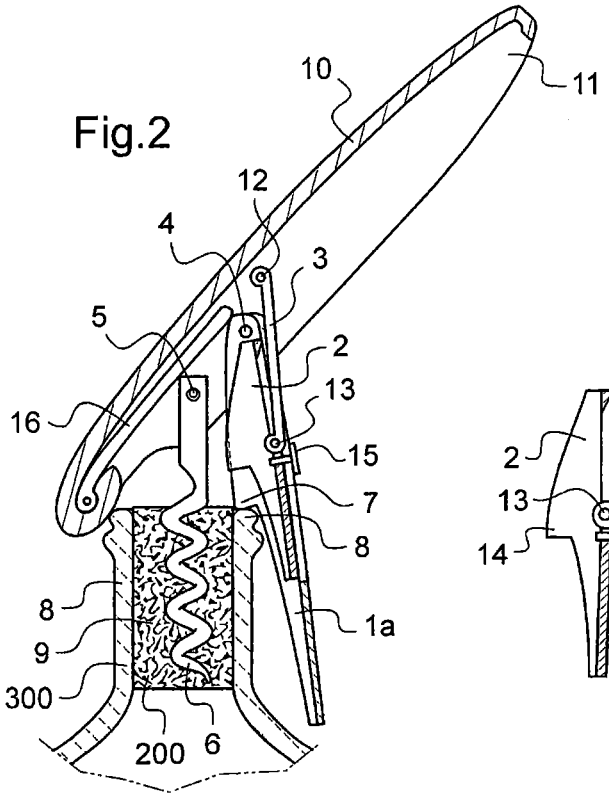
Fig.3
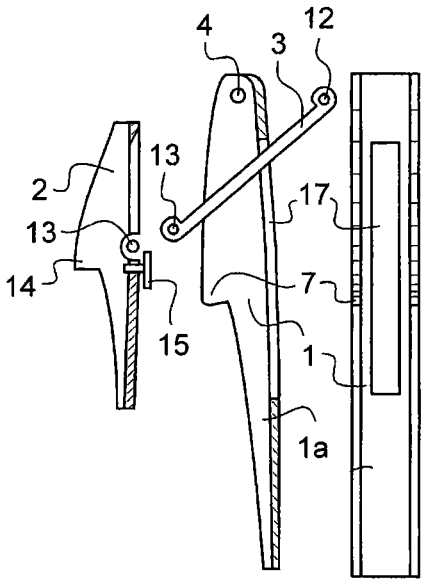

Fig.6
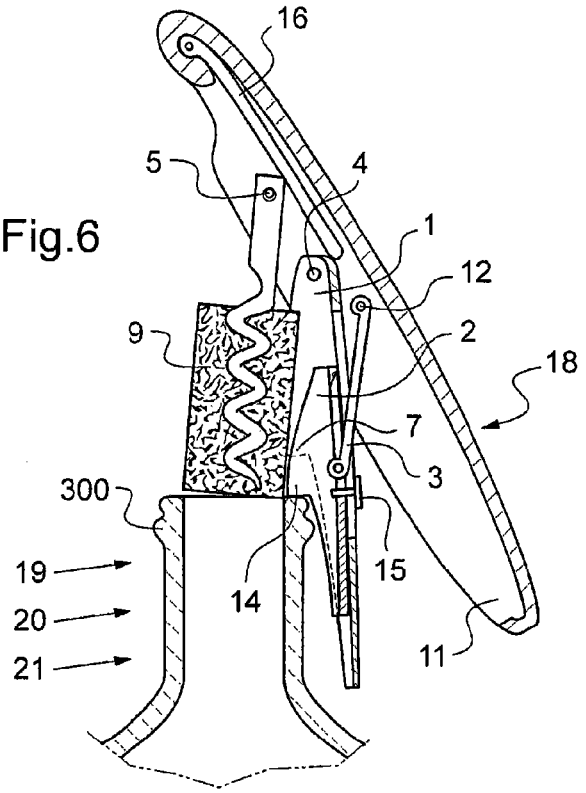
Fig.7
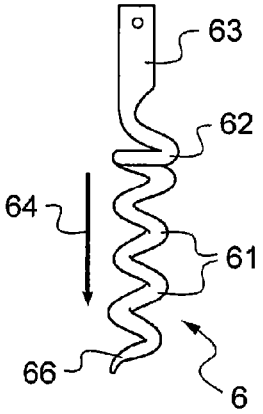
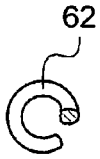
Fig.8
Fig.9
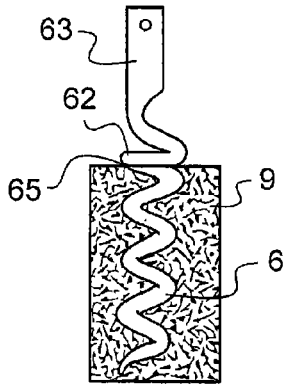

DOUBLE LEVER CORKSCREW

CROSS-REFERENCE TO RELATED APPLICATIONS

This application is a national stage application (under 35 U.S.C. §371) of PCT/FR2011/000174, filed Mar. 24, 2011, which claims benefit of French application 1002997, filed May 12, 2010, the contents of each of which are incorporated herein by reference in their entireties.

This invention relates to a lever corkscrew. More specifically, the invention relates to a double lever corkscrew including two fulcrums. The waiter's friend-type corkscrew allows a cork to be fully extracted in a single movement.

In different sectors, including in the food sector, bottles containing a liquid are sealed by corks. The cork allows the spillage or evaporation of the liquid contained in the bottles to be avoided. In order to gain access to the liquid, one needs to extract the cork.

Bottle corks are generally made from an elastic material such as, for example, cork or a polyethylene or styrene-type synthetic material.

Corkscrews generally include at least a handle and a worm screw-type auger. Usually, each auger includes an end-of-run tip arranged so as to position the said auger on the surface of a cork for extraction. Manual pressure on the handle has the consequence that the tip pierces the upper surface of the cork. The spirals of the auger then allow the tip to sink deep into the cork through a rotational movement exerted on the handle.

It is known for a corkscrew to be equipped with a stop part, which forms a lever with the handle. The stop part is arranged so as to come to rest on the bottleneck. A tilting movement exerted on the handle allows the cork of the bottle to be partially extracted. In order to fully extract the cork from a bottle, one then needs to manually exert a traction force on the cork, which is sometimes difficult.

In addition, according to the prior art, the auger of a corkscrew penetrates into the cork without it being possible to control the progress of its tip.

Thus, sometimes the tip does not penetrate sufficiently into the cork to allow it to be properly extracted. The stop part may also sometimes be unable to obtain the correct support from the bottleneck to form the lever.

It may also be that the tip passes through the cork to be extracted. The first resulting inconvenience of this is the contamination of the liquid in the bottle by cork debris. The second resulting inconvenience is that the stop part cannot obtain proper support from the bottleneck in order to form the lever.

The present invention is designed to improve this situation.

To this effect, this invention concerns a corkscrew including an elongate body, an auger hingedly mounted onto said body via a main transverse pin, a first bearing arm hingedly mounted onto the body via a second pin parallel to the main transverse pin and at a first distance from said main transverse pin so as to form a first lever having a shoulder, and a second bearing arm arranged so as to form a second lever having a shoulder. The second bearing arm of the corkscrew is slidably mounted onto the first bearing arm and is hinged onto one end of a connecting rod, whose other end is hingedly mounted onto the body via a third pin that is also parallel to the main transverse pin but at a second distance from said main transverse pin, said second distance being greater than said first distance. The connecting rod is proportioned and positioned, in relation to the two bearing arms and to the body, so that after the auger has been screwed into a cork and the first lever has engaged with the rim of the bottleneck, this first lever begins the extraction of the cork by tilting the elongate body, and during said tilting the second lever in turn engages with the rim of the bottleneck in order to take over from the first lever and to complete the extraction of the cork.

According to one embodiment, the first bearing arm includes an indentation. The connecting rod is arranged so that it crosses the said indentation.

According to a particular embodiment, the main longitudinal pins of the said bearing arms are held approximately parallel while the second bearing arm is slid onto the first bearing arm.

A means of attachment may be arranged in proximity to a dorsal part of the first bearing arm and be mounted so as to cross into the indentation, the said means of attachment being attached to the second bearing arm in order to guide the latter during a sliding movement along the indentation.

A spring may be provided for so as to extend within a longitudinal plane of the elongate body, the spring being arranged to be in contact with the auger and the first bearing arm.

A tongue may extend from the end of the first bearing arm so as to form a guide support for the second bearing arm while it is engaged with the bottleneck and until the extraction of the cork is complete.

The auger may include threads arranged in a spiral around its main longitudinal pin.

The auger may include a stop thread arranged within a plane approximately perpendicular to the main pin of the auger.

Other benefits and characteristics of the invention will be apparent on reading the detailed description below and from the attached drawings in which:

FIG. 1 depicts a cross-section of a corkscrew, under the invention, engaged in the cork of a bottle;

FIG. 2 depicts the corkscrew from FIG. 1 with the first lever engaged with the rim of the bottleneck;

FIG. 3 depicts a slide-mounting arrangement of a second bearing arm on a first bearing arm, according to the invention;

FIG. 6 depicts the corkscrew from FIG. 1 and the extraction of the cork by tilting the elongate body;

FIG. 7 depicts an auger including a stop thread, according to one embodiment of the invention;

FIG. 8 depicts a cross-section of a stop thread; and

FIG. 9 depicts the auger from FIG. 7 engaged in the cork of a bottle;

Figure 4:
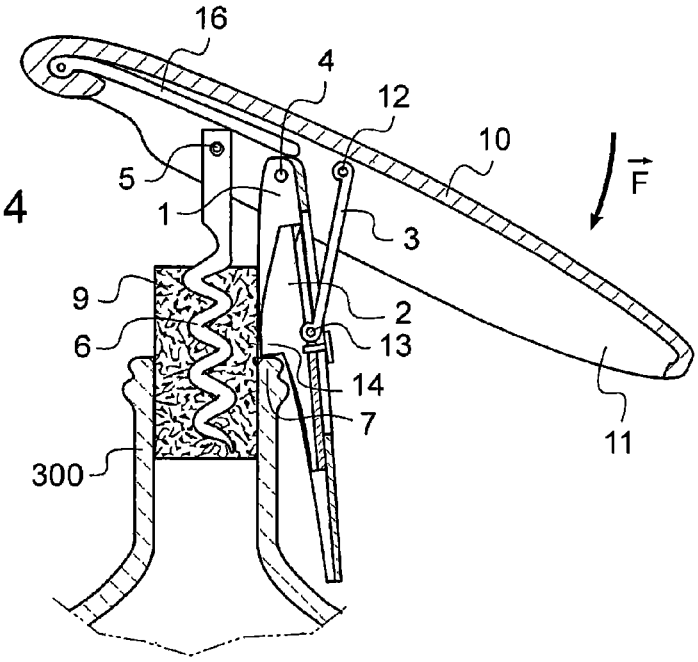
FIG. 4 depicts the corkscrew from FIG. 1, whose first lever is starting to extract the cork via a tilting of the elongate body.

The drawings and descriptions below essentially contain information of a definite nature. They form an integral part of the description and may therefore serve not only to enhance comprehension of this invention, but also to contribute to its definition, if appropriate.

Reference is made to FIGS. 1 and 2, which depict a cross-section of a corkscrew under the invention engaged in a cork 9 of a bottle 300.

The corkscrew 100 includes an elongate body 10. The elongate body is usually arranged so as to serve as a handle for a user.

The corkscrew 100 also includes an auger 6. The auger 6 is hingedly mounted on this body 10 via a main transverse pin 5. The auger 6 is a screw-type auger including threads arranged in a spiral around a main longitudinal pin. The auger 6 beneficially includes a tip at the end in order to facilitate penetration into a cork.

The auger 6 includes a base 63 with a recess to allow hinged mounting onto the body 10 via the main transverse pin 5.

As FIG. 1 shows, the engaged state of the corkscrew in the cork 9 is achieved through the penetration of the auger 6 into the cork 9. Here, the cork 9 is a standard cork made from an elastic material, such as cork, for example.

The corkscrew 100 includes a first bearing arm 1 hingedly mounted on the body 10 via a second pin 4 parallel to the main transverse pin. The said second pin 4 is at a first distance from the main transverse pin 5 so as to form a first lever with a shoulder 7 (or a heel 7).

The corkscrew 100 also includes a second bearing arm 2 arranged so as to form a second lever with a shoulder 14 (or a heel 14).

The second arm 2 is connected to the elongate body 10 via the intermediation of a connecting rod 3. One end of the connecting rod 3 is connected to the elongate body, while the other end of the connecting rod 3 is connected to the second bearing arm 2. More specifically, at one of those ends the connecting rod 3 is hingedly mounted onto the elongate body 10 via a third pin 12. The third pin 12 is also parallel to the main transverse pin 5. The other end of the connecting rod 3 is attached to the second bearing arm 2 via a fourth pin 13. In the embodiment described, the fourth pin 13 is also parallel to the main transverse pin 5.

The third pin 12 is at a second distance from the main transverse pin 5. The said second distance is greater than said first distance described above (remembering that the first distance is the distance between the second pin 4 and the main transverse pin 5.

In particular, the hinged mounting of the bearing arms 1 and 2 and of the auger 6 allows these parts to be folded down into the elongate body 10. FIG. 1 shows bearing arms 1 and 2 in a folded down position in the elongate body 10, whereas FIG. 2 shows the bearing arms 1 and 2 in a working position.

More generally, it needs to be understood that each transverse pin connects two elements: for example, the auger 6 is connected to the elongate body 10 via the transverse pin 5.

Each transverse pin allows for the rotational movement of one element in relation to the other. In other words, each transverse pin allows a degree of freedom for one element to rotate within a plane. The said planes are approximately parallel or joined.

The second bearing arm 2 is slidably mounted 15 on the first bearing arm 1.

FIG. 3 shows a slide-mounting arrangement of a second bearing arm 2 on a first bearing arm 1 according to the invention. The slide-mounting is achieved so that the bearing arms 1 and 2 slide longitudinally in relation to one another.

In other words, if each bearing arm is deemed to possess a main longitudinal pin, during a sliding movement of one arm in relation to the other, the main longitudinal pins remain parallel to one another. It therefore needs to be understood that there is no degree of rotational freedom between the first 1 and the second 2 arms.

The second bearing arm 2 of the corkscrew under the invention slides in a stable and regular manner within the first bearing arm 1. According to one embodiment, the first bearing arm 1 includes an indentation 17 (or a groove 17). In particular, the said indentation is provided in order to allow the connecting rod 3 to pass through.

The second bearing arm 2 is mounted rear-facing to the said indentation and is held in position by the connecting rod 3, on the one hand, and by a means of holding 15 on the other. The means of holding 15 may be a wide-headed screw, the diameter of whose head exceeds the transverse recess of the indentation 17. Thus, on the surface the head of the wide-headed screw slides onto the dorsal part of the first bearing arm 1, which provides further stability. In addition, the means of attachment 15 holds the second bearing arm 2 alongside the first bearing arm 1.

According to the invention, the connecting rod 3 is proportioned and positioned, in relation to the two bearing arms 1 and 2 and to the elongate body 10 so that after the auger 6 has been screwed into a cork and the first lever has engaged with the rim of the bottleneck 300, this first lever starts the extraction of the cork 9 through the tilting of the elongate body 10, tilting during which the second lever in turn comes to engage with the rim of the bottleneck 300 so as to take over from the first lever and to complete the extraction of the cork 9.

Figure 5:
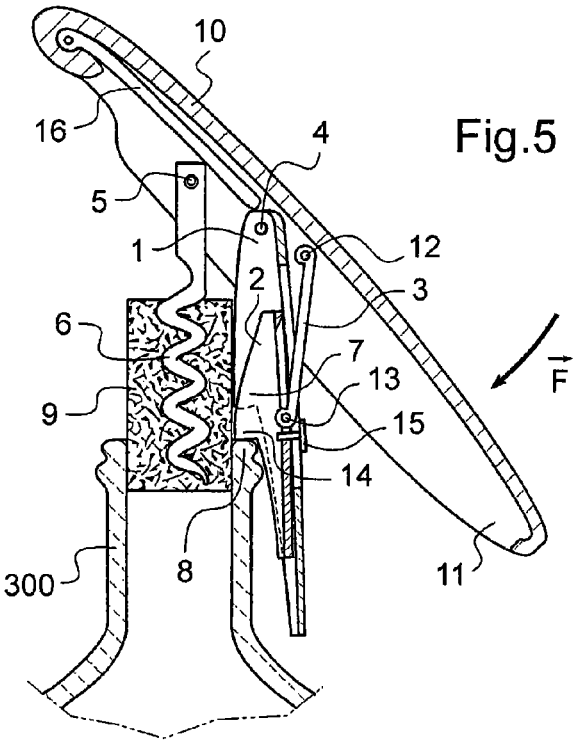
FIG. 5 depicts the corkscrew from FIG. 1, whose second lever is coming to take over from the first lever and to continue the extraction of the cork.

Reference is now made to FIGS. 2, 4, 5 and 6, which respectively show the progression of the extraction of a cork 9 by means of the corkscrew according to the invention.

At a time $t_0$ (see FIG. 2), the end 11 of the elongate body 10 of the corkscrew 100 is lifted. The two bearing arms 1 and 2 are in a position where they are folded down in the direction of the neck of the bottle 300. The shoulder 7 of the first bearing arm 1 is positioned so that it is engaged with the rim 8 of the bottleneck.

In this starting position, the connecting rod 3, which is connected to the elongate body 10 of the corkscrew 100 via the third pin 12 and to the second bearing arm 2 via the fourth pin 13, keeps the second bearing arm 2 in proximity to an upper part of the first bearing arm 1. In other words, the connecting rod 3 makes the second bearing arm 2 slide towards the top of the first bearing arm 1 when the corkscrew is arranged in a starting position for the extraction of the cork 9.

At a time $t_1$ (see FIG. 4), a force F is exerted on the elongate body 10. The force F is exerted by bringing the end 11 of the elongate body 10 down to the bottom (in the direction of the bottle 300). Through the application of the force F, the auger 6 exerts a traction force on the cork 9. By pulling on the cork 9, the auger 6 detaches it and starts to extract it. The connecting rod 3 causes the second bearing arm 2 to slide in a downward direction (in the direction of the bottle 300) until its shoulder 14 reaches the height of the shoulder 7 of the first bearing arm 1.

At a time $t_2$ (see FIG. 5), the application of the force F continues (a user may, for example, exert a force of downward pressure on the elongate body). In combination with the connecting rod 3, the second bearing arm 2 possesses a greater and quicker operating range than the first bearing arm 1 does. Consequently, it is the second bearing arm 2 that now rests with its shoulder 14 against the rim of the bottleneck 300. The traction movement of the auger 6 is extended and accelerated so as to pull the cork 9 further.

At a time $t_3$ (see FIG. 6), it is sufficient to take the elongate body 10 of the corkscrew and the bottleneck 300 as a whole in the hollow of the hand, with the thumb cavity (arrow 18) on the shaft and the other fingers (arrows 19, 20 and 21) on the bottleneck 300 and by squeezing it all, the second bearing arm 2 will push even more on the rim 8 of the neck giving the auger 6 a traction distance such that it fully extracts the cork 9, bringing it outside the neck of the bottle 300.

Through its two bearing arms 1, 2, connected via their respective transverse pins to the elongate body 10, the invention allows for the formation of two levers. The first lever has a shorter working distance, but one that is more powerful because it is attached to the said elongate body by the second pin 4, which is at a first distance from the main transverse pin 5. The second pin 4 is brought closer to the main transverse pin 5, which attaches the auger 6 onto the elongate body 10. The second pin 4 is brought closer to the main transverse pin 5 so as to give the auger 6 sufficient traction force to easily detach the cork 300 and to begin to extract it.

The second lever has a longer, quicker operating distance because it is moved by the connecting rod 3 that is mounted on the elongate body 10 via a third pin 12. The third pin 12 is at some distance from the main transverse pin 5 that attaches the auger 6 to the elongate body 10. The third pin 12 is at some distance from the main transverse pin 5 so as to take over from the first lever when the latter reaches the end of its run. The second lever extends the potential to exert pressure on the rim of the neck 8 of the bottle 300 and thereby to give the auger 6 a greater traction distance so as to fully extract the cork 9 from the bottle 300.

As a second characteristic, these two actions are completed automatically simply through pressure on the end 11 of the shaft 10 of the corkscrew, FIGS. 1, 2, 4 and 5, thanks to the action of the connecting rod 3, which rests through its pin 12 on the body of the corkscrew 10 and works lever 2 through its pin 13 so as to make it slide automatically inside the lever 1 as it adopts its different positions.

According to one embodiment, the corkscrew under the invention includes a spring 16 allowing the maintenance of the auger 6 in a vertical position (working position) to be reinforced. The spring 16 also allows the maintenance of the auger 6 in a folded-down position, namely within the elongate body 10, to be reinforced. The spring 16 also allows the maintenance of the first bearing arm 1 in a folded-back (or folded-down) position within the elongate body 10 to be reinforced.

Beneficially, the first bearing arm 1 includes a tongue 1*a*. The tongue 1*a* is extended so as to allow the second bearing arm 2 to slide to a required distance. More specifically, the said tongue la extends onto a part of the end of the first bearing arm 1. In the position where the first bearing arm 1 engages with the neck of the bottle 300, the tongue la is oriented towards the bottom of the said bottle 300.

The first bearing arm 1 and the second bearing arm 2 have the same working angle during their engagement with the bottleneck and, therefore, during the extraction of the cork. The forces that arise while the said arms are being worked, particularly during the operation of the second bearing arm 2, are significant. Indeed, during the engagement of the second bearing arm 2, namely when the shoulder 14 is engaged with the rim 8 of the neck, the force exerted by the second lever on the neck may be very great (through the effect of the second lever). Thus, in order to maintain proper positioning while the second bearing arm 2 is being used to extract the cork 9, and particularly in order to avoid any disengagement of the shoulder 14 from the neck, it is beneficial to provide positive, secure guidance for the second bearing arm 2. This is achieved through the tongue 1*a*, which, in particular, allows the dorsal part of the second bearing arm 2 to lean against the interior of the latter, until it reaches the end of its run (see FIGS. 4-6).

The tongue 1*a* also allows a good hand grip to be retained.

Reference is made to FIGS. 7 and 9, which depict an auger according to one preferred embodiment of the invention. The auger 6 is of the worm screw type, which extends in one direction 64. The auger 6 includes threads 61 arranged in a spiral around a main longitudinal pin. The auger 6 beneficially includes a tip 66 at the end in order to facilitate penetration into a cork 9.

The auger 6 includes a base 63 with a recess in order to allow hinged mounting on the body 10 via the main transverse pin 5.

The auger 6 also includes a stop thread 62. Here, this is the first spiral in proximity to the base 63. The stop thread 62 is flattened into a plane approximately perpendicular to the main pin of the auger 6.

FIG. 8 depicts a cross section of the stop thread 62 and shows that it forms an open ring.

While the auger 6 is achieving penetration, the stop thread 62 controls the progress of the tip and thereby controls the relationship of the first bearing arm 1 to the shoulder 7. In effect, the stop thread 62 comes to a stop against the upper surface 65 of the cork 9 and thereby defines the limit of penetration of the auger 6 into that cork. Thus, engagement by the shoulder 7 of the first bearing arm 1 may be defined physically.

The invention can also be defined as stated below.

This is a double-lever device with two fulcrums for a lever-operated, waiter's friend corkscrew characterised in that it includes a lever 1 that has a fulcrum pin 4 close to the pin 5 of the auger 6 and a lever 2 that has a fulcrum located at a greater distance from that pin 5 by means of a connecting rod 3 and that slides into the lever 1 in order to automatically take over from the lever 1 when this reaches the end of its run so as to extend the pressure on the rim of the neck 8 of the bottle and to give the auger 6 a greater traction distance so as to thereby fully extract the cork 9.

The lever 2 may be moved by a connecting rod 3 whose pin 12 leans on the body 10 of the corkscrew and acts on the lever 2 via its pin 13 so as to automatically make it slide inside the lever 1 according to its different positions.

The pin 12 of the connecting rod 3 is at a greater distance from the pin 5 of the auger 6 than the pin 4 of the lever 1 so as to give the lever 2 a greater working distance than lever 1, allowing it to take over from the latter so as to automatically extend the pressure effect on the rim 8 of the bottleneck and to give the auger 6 a greater traction distance and to thereby fully extract the cork. The spring 16 in FIG. 2 serves to hold the auger 6 in its vertical or folded back position inside the shaft and to keep the lever 1 in its folded down position inside the shaft (FIG. 1).

The tongue 1*a* of the lever 1 is extended in order to allow the lever 2 to slide to the required distance as well as to allow a good grip in the hand.

The invention claimed is:

1. A corkscrew comprising an elongate body;

an auger pivotally mounted to the elongate body about a first axis;

a first bearing arm pivotally mounted to the body about a second axis parallel to and at a first distance from the first axis and including a first shoulder;

a second bearing arm including a second shoulder, the second bearing arm being slidably engaged with the first bearing arm, the second shoulder being aligned adjacent the first shoulder;

a connecting rod pivotally mounted to the elongate body about a third axis parallel to and at a second distance from the first axis, the second bearing arm being pivotally engaged with the connecting rod, the second distance being greater than the first distance.

2. The corkscrew of claim 1 being for the removal of a cork from a bottle having a rim around the cork, the connecting rod being proportioned and positioned, in relation to the two bearing arms and to the body, so that after the auger has been screwed into the cork and the first lever has engaged with the rim of the bottle, the first lever begins the extraction by means of tilting the elongate body relative to the bottle and the second lever in turn overtakes and engages the rim of the bottle as the tilting of the elongate body continues in order to take over from the first lever and to extract the cork.

3. The corkscrew of claim 1, the first bearing arm further including an indentation, the connecting rod extending through the indentation between the pivotal engagement with the second bearing arm and the pivotal mounting to the elongate body.

4. The corkscrew of claim 3, the second bearing arm further including an attachment to slidably engage the first bearing arm at the indentation.

5. The corkscrew of claim 1 further comprising a spring extends within a longitudinal plane of the elongate body, the spring being arranged in contact with the auger and with the first bearing arm.

6. The corkscrew of claim 1, the first bearing arm further including a tongue extending from an end of the first bearing arm forming a guide support for the second bearing arm.

7. The corkscrew of claim 1, the auger including a stop thread arranged in a plane approximately perpendicular to the longitudinal extent of the auger.

8. A corkscrew comprising an elongate body;

an auger pivotally mounted to the elongate body about a first axis, the auger including a stop thread arranged in a plane approximately perpendicular to the longitudinal extent of the auger;

a first bearing arm pivotally mounted to the body about a second axis parallel to and at a first distance from the first axis and including a first shoulder;

a second bearing arm including a second shoulder;

a connecting rod pivotally mounted to the elongate body about a third axis parallel to and at a second distance from the first axis, the second bearing arm being pivotally engaged with the connecting rod, the second distance being greater than the first distance.

* * * * *